United States Patent [19]

Meihuizen et al.

[11] 4,137,394

[45] Jan. 30, 1979

[54] PROCESS FOR CONTINUOUS PREPARATION OF FIBROUS POLYMER CRYSTALS

[75] Inventors: Cornelis E. Meihuizen, Groningen; Albertus J. Pennings, Norg; Arie Zwijnenburg, Groningen, all of Netherlands

[73] Assignee: Stamicarbon, B.V., Geleen, Netherlands

[21] Appl. No.: 797,834

[22] Filed: May 17, 1977

[30] Foreign Application Priority Data

May 20, 1976 [NL] Netherlands ..... 7605370

[51] Int. Cl.[2] ..... C08F 10/02; C08F 6/06

[52] U.S. Cl. ..... 528/502; 264/176 F; 526/352

[58] Field of Search ..... 528/502, 503; 264/176 F, 184, 8; 526/352

[56] References Cited

U.S. PATENT DOCUMENTS 3,962,205 6/1976 Ward et al. ..... 528/502

4,020,266 4/1977 Frank et al. ..... 528/502

FOREIGN PATENT DOCUMENTS 46-38339 11/1971 Japan ..... 528/502

1142253 2/1969 United Kingdom ..... 528/502

OTHER PUBLICATIONS

Pennings et al.; Kolloid Zeit. 236 (1970) 99–111.

Pennings et al.; Kolloid Zeit. 251 (1973) 500–501.

*Primary Examiner*—Jay H. Woo

*Attorney, Agent, or Firm*—Cushman, Darby & Cushman

[57] ABSTRACT

Filament-like polymer crystal fibers are prepared from a solution of a crystallizable polymer, such as polyethylene or polypropylene, in a vessel containing a spinning rotor, preferably having a slightly roughened surface, according to the disclosed invention. The fiber thus formed is taken up and removed at a rate equal to the crystal growth rate. The longitudinal crystal growth rate is of sufficient speed for commercial application while at the same time yielding fibers of outstanding mechanical properties.

17 Claims, 3 Drawing Figures

PROCESS FOR CONTINUOUS PREPARATION OF FIBROUS POLYMER CRYSTALS

BACKGROUND OF THE INVENTION

The present invention relates to a process for continuous preparation of filament-like polymer crystals from a solution of a crystallizable polymer, such as polyethylene and polypropylene, wherein a seed crystal grows longitudinally in the flowing solution and the grown polymer filament thus produced is removed from the polymer solution at an average rate which is equal to the growth rate.

In the publication Colloid and Polymer Sci. 253, 452–461 (1975), by Zwijnenburg, A. and Pennings, A. J., the formation of filament like polyethylene crystals from a xylene solution thereof in a Poiseuille flow is described. At the beginning of a capillary, through which flows an undercooled solution of polyethylene is xylene, a polyethylene seed crystal is suspended in said polyethylene solution. Then, by winding the longitudinally growing crystal on a reel at a rate which is equal to the growth rate, an endless filament-like polymer crystal can be prepared. This technique resembles that of Czochrakshi as described in Phys. Chem. 92, 219 (1918) for the growth of single crystals of metals and inorganic substances, the difference of course, being that the growing polymer crystal forms from a solution which is subject to a Poiseuille flow. It was thought then that the growth rate was determined by the quantity of polymer solution that flowed past the seed crystal.

Although the mechanical properties of the filaments according to the Zwijnenburg et al process are extraordinarily good, the longitudinal growth rate is much too small for the process to be of industrial significance. The object of the present invention, therefore, is to provide a process and apparatus in which a considerably greater growth rate of the crystals is obtained.

Another object of the present invention is to provide filaments having extraordinarily good mechanical properties.

Further objects of the invention will appear from the following specification, drawing and examples.

DETAILED DESCRIPTION OF THE INVENTION

In accordance with the present invention, a process is provided for growing filament like polymer crystals with an increased growth rate from a solution of a crystallizable polymer, where a seed crystal is grown longitudinally in the flowing polymer solution and where the filament-like polymer crystal is removed from the solution at an average rate that is equal to the growth rate. According to this process the longitudinal growth takes place at a surface while the surface moves in the direction of crystal growth, and the filament-like crystal contacts the surface over a length of at least 15 cm. Preferably this surface is not quite smooth, i.e. slightly roughened. We have found that while smaller lengths of contact between the growing crystal and the moving surface also lead to growth, such shorter lengths are not of practical significance due to the smaller growing rates and the lower mechanical properties of filaments so manufactured.

An embodiment of the principle as described above is that the longitudinal growth takes place in a Couette flow, in which the filament like crystal is in contact, over a length of a rotating surface and at least 15 cm of that surface with the rotor generating this flow. A flow of this kind is formed in a rotation-symmetrical vessel such as a cylinder, in which a rotor is rotating. A solution of a crystallizable polymer is maintained in the space between the internal wall of the vessel and the external wall of the rotor. During operation the solution is caused to flow by the rotation of the rotor. This flow and other aspects of the invention will be further explained and illustrated by the appended drawing.

DETAILED DESCRIPTION OF THE INVENTION

Figure 1:
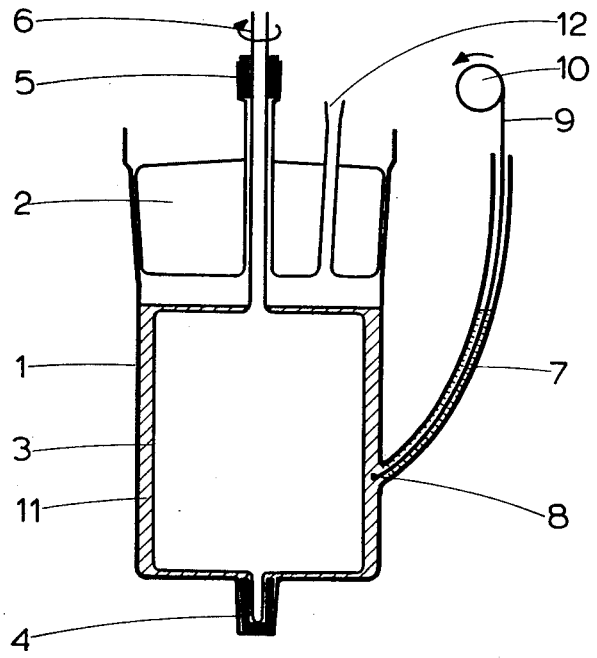
FIG. 1 is a cross-sectional view of an apparatus typical of the type used in conducting the process of the present invention.

The device for producing filament-like polymer crystals from a solution of a crystallizable polymer, in the manner as explained above, is illustrated in FIG. 1 and includes a cylindrical vessel or container 1 closed at the top by a stopper 2 or like sealing means. A rotor 3 is provided inside of the cylindrical vessel 1 the outer walls of the rotor and vessel being positioned in relatively close proximity to each other. The rotor 3 is mounted on either end by Teflon bearings 4 and 5 which provide seals for the container and allow the rotor to rotate via shaft 6 by a motor, not shown.

A thin tube 7, preferably of Teflon is secured to and in fluid communication with vessel 1 positioned at an angle slightly tangential with respect to the vessel. The seed crystal is introduced at point 8, that portion of tube 7 communicating with the inside of vessel 1. As the polymer filament 9 is produced from point 8 and inside tube 7, a reel 10 is provided for winding. Inside the vessel a space 11 between the rotor and vessel wall is provided for the polymer solution, as illustrated; polymer solution is supplied to the vessel via supply port or opening 12.

According to the present invention in its apparatus aspect a closed vessel is provided containing a rotor which is positioned close to the inside wall of the vessel. The vessel is provided with a polymer supply port and a fiber removal port in the form of a relatively thin tube positioned tangentially adjacent the rotor and in an upward facing direction with respect to the vessel. The rotor surface is preferably slightly roughened. Operation of the apparatus as illustrated in FIG. 1 is described in the following examples.

The use of a Couette type crystallization vessel is suggested in the Colloid and Polymer Sci 253, 460 (1975) noted above. This is based on the view that the crystallization time should be defined by the quantity of polymer solution in the reservoir. We have found quite surprisingly that the situation of a longitudinally growing crystal lying against a surface, preferably non-smooth, is much more important than is the macroscopic flow pattern.

In such a process the crystal formed lies on the external wall of the rotor and is wound around the rotor at least partially, or completely, or even several times. In the event that the crystal is wound around the rotor several times it may be necessary that the rotor have shape such that the windings do not touch one another. This can be accomplished with a conical rotor or by a vertical flow component along the rotor surface or with variations of the two. A device for conducting the process of the present invention is, however, not limited to the particular design and modifications mentioned above.

With regard to the moving surface in general, and specifically the rotor 3, it is preferred that the moving surface is not quite smooth, that is such surface has a slightly discontinuous surface. We have observed that the longitudinal growth of the polymer crystals is larger if the surface is slightly rough. To this end, the rotor surface may, for instance, be sandblasted. It has further appeared that the longitudinal growth of the polymer crystals can be substantially increased by providing that the wall in contact with a non-polar crystal is itself non-polar. This can be done for instance by treating a glass rotor, which is usually used in prototype work, with a methylchlorosilane to provide a coating thereon.

The rate of removing the growing filament from the solution, hereinafter to be called the reeling speed must, on the average, be equal to the growing speed, in order to maintain the growing tip of the filament in about the same position. It appeared that the reeling speed can vary within certain limits, that are dependent on the other conditions and that can be easily determined experimentally. With an increasing reeling speed the filament becomes thinner. The upper limit of the reeling speed is determined by the filament becoming so thin that it breaks, or by the growing tip of the filament no longer remaining in the same position. The lower limit of the reeling speed is also determined by the growing tip of the filament no longer remaining in the same position, so that the length of the contact between the filament and the moving surface increases.

We have found that there appears to be an optimum relationship between: (a) the rate of the longitudinal growth of the polymer crystals, (b) the concentration of the polymer solution, (c) the reeling speed of the filament, and (d) the flow rate of the solution, the flow rate being determined by the peripheral speed of the rotor.

At a given concentration the optimum peripheral speed of the rotor can be determined experimentally by the operator in a very simple manner and subsequently maintained at that speed.

According to our experiences we have found that under optimum conditions invariably more than 15 cm of the formed crystal was found around the rotor.

The length of 15 cm indicates a minimum length for practical use. The length of contact depends on two factors, namely, the speed of the moving surface, that is the rotor speed, and the growth rate which is at the same speed with which the fibrous crystal should be removed from the solution or collected on reel 10, or reeling speed as used below. The speed of the moving surface, e.g. the rotor speed, must be adjusted to be within certain limits with respect to the reeling speed. As a general rule the rotor speed or moving surface speed will generally be at least twice the reeling speed. Too high rotor speed may be disadvantageous due to easy breaking of the filament and while greater rotor speeds are possible, the rotor speed to reeling speed ratio will generally be under 50, preferably under 25 and in particular under 10.

As a solvent for linear polyolefine we prefer to use p-xylene. Other solvents such as a decalin, perchloroethylene, paraffin wax, hydrocarbons, terpene, naphthalene, and the like may be used. A solution of about 0.5 weight percent is preferred; less or more concentrated solutions are also suitable. From practical considerations a concentration will not be selected below 0.05 percent by weight. The viscosity increases with increasing concentrations and in general the concentration will therefore not be selected to be over 5 percent by weight, though in principle higher concentrations may be used. Solutions too viscous are difficult to handle. On the oher hand it was found that thicker filaments are produced from more concentrated solutions. The viscosity of polymer solutions is not only dependent on the concentration, but also on the molecular weight of the polymer, the temperature and the solvent. Any person skilled in the art will be able to select the process conditions of the present process in such a way that it can be carried out with solutions that can be handled adequately. For solutions of polyethylene or very high molecular weight e.g. as was used in the following examples, the concentration is preferably not over 5 percent by weight. Preferably the solution is stabilized with an antioxidant.

It will be clear that the temperature of the solutions from which the filaments are grown must be selected such that growth of the seed crystal occurs. It is known that in crystallizing monomeric compounds as salts in water, there is a temperature above which a seed crystal dissolves and below which crystals grow. In polymeric solutions this appears to be less simple. The thermodynamical equilibrium temperature of solutions of high density polyethylene is p-xylene is 118.6° C. However, it has been found that growth of a seed crystal can occur above 118.6° C. We presume that by means of the rotating rotor and the flow of the solution, due to the rotating rotor, a stretching of the polymer molecules is effected. Consequently, the free energy of the molecules is increased and as a result the undercooling is increased. At the dynamic equilibrium temperature and slightly over it crystallization can still occur. The most suitable temperature for growing filaments from a polymeric solution can be easily determined experimentally by the skilled operator.

The filament-like polymeric crystals of the present invention can be produced in an apparatus as shown in FIG. 1 schematically and as explained in Example I. The present process is, however, not necessarily limited to the use of such an apparatus. Each embodiment where a seed crystal is grown longitudinally at a moving surface and where the filament like polymeric crystal contacts the moving surface over a length of at least 15 cm falls within the scope of the present invention. In case the moving surface is a rotor surface, the rotor axis can be positioned horizontally. The rotor may be mounted, for example, in a suitable trough with an opening in its upper side for drawing the filament out of the solution. When the opening in the upperside of the trough is a slit a number of filaments can be grown simultaneously in a row at short distance from each other. It will be apparent that other moving surface/-polymer solutions may be used and these too are comprehended by the present invention.

We have found that the filaments produced according to the process of the present invention have exceptionally good mechanical properties. Particularly their tensile strength is considerably better than that of the corresponding polymer itself according to the present process, polyethylne filaments weighing 0.0001 to 0.0012 mg/cm can be manufactured, having a tensile strength of over 100 kg/mm$^2$, an E- modules of over 2200 kg/mm$^2$ and an elongation at break of less than 25 percent glass filaments generally have an E-modules between 7,000 and 8,000 kg/mm$^2$, but their tensile strength is only 2 to 10 kg/mm$^2$. The present filaments can thus serve as a total or partial replacement for glass filaments. Further, the low specific weight of less than 1.0 of the present fibers may be advantageous as compared to the specific weight of glass being about 2.5.

Although the following examples are specifically directed to linear polyolefins as the crystallizable polymer, the present invention is in no way limited thereto. Rather the processes and apparatus here disclosed are useful with all crystallizable polymers, the optimum formation conditions for which are adapted to their character. Unless otherwise indicated all parts and percentages are by weight.

EXAMPLE I

A high density polyethylene was dissove in p-xylene to form a 0.5% by weight solution. The polyethylene, which is a commercial product sold under the name Hostalen GUR, had the following characteristics: the intrinsic viscosity in decalin at 135° C. was 15 deciliters/g; the molar weight (number average) $M_n$ was $10 \times 10^4$ determined osmometrically; and the molar weight (weight average) $M_w$ was $1.5 \times 10^6$, determined by light scattering in α-chloronaphthalene at 135° C.

The various polyethylene solutions prepared were stabilized with 0.5% by weight of the antioxidant Ionol DEPC which is ditertiary butyl parcresol, and all tests were conducted under pure nitrogen. Fibrous polyethylene crystals were chosen as seed crystals. These crystals were obtained from an 0.1% p-xylene solution of the polyethylene polymer as described above. The crystals were 40 mm long and has a cross-section of $0.25 \times 0.10$ mm.

The device shown in FIG. 1 for conducting the following tests as described above the equipment included a cylindrical vessel 1 shut off at the top by stopper 2, a rotor 3 bearing-mounted in Teflon at 4 and 5, which was rotated at the indicated speed via shaft 6. A thin Teflon tube 7 was attached at the outside of the vessel, in contact with the inside and mounted slightly tangentially. The seed crystal could be introduced through the aperture 8. In the apparatus as described the external diameter of the rotor was 112 mm and the internal diameter of the vessel 135 mm leaving about a 22 mm space (11) to be filled by the polymer solution. The filament 9 was wound on a reel 10. The spece 11 was filled with a polymer solution, which could be supplied through an aperture 12; the tube 7 was filled with solvent to externally clean the filament of adhering solution. The entire device was submerged in a thermostatic bath which kept the temperature constant to within ±0.01° C.

A. First, two comparative tests were conducted: (1) a test wherein only the tip of the growing crystal was close to the rotor; and another series of the tests (2) in which 20 cm of the growing crystal was contacting the rotor.

(1) in an 0.5 polyethylene solution the longitudinal growth as a direct function of the reeling speed at 103° C. and a rotor speed of 20 rpm, indicating rotations per minute, was only 0.8 cm/min.

(2) under the conditions of temperature and rotational speed the longitudinal growth or reeling speed could be increased to 20 cm/min at only 2 rpm of the rotor.

B. Under the conditions of A, part 2, and within the rotational speed range from 0.8 rpm to 4 rpm, the growth rate can be varied between 8 cm/min. and 31 cm/min. The mass of the fiber could be increased from $27 \times 10^{-5}$ mg/cm.

C. The influence of the character of the rotating contracting the growing crystal appears from the following table, the tests being conducted at 2 rpm at 103° C. and 20 cm of

TABLE

| Fiber mass in mg/cm | growth rate (reeling speed) in cm/min. | Character of the surface of the rotor |
|---|---|---|
| 15 | 20 | smooth (Teflon) |
| 40 | 31 | sandblasted glass |
| 59 | 31 | silanized, sand-blasted glass |

D. Contrary to original expectations, we found that the tensile strength of the fiber so produced in fact increases with the reeling speed. For instance, starting from a solution of 0.5% polyethylene in xylene at 110° C. the tensile strength is: 200 kg/mm$^2$ at a reeling speed of 20 cm/min and 300 kg/mm$^2$ when increasing the reeling speed of 80 cm/min.

EXAMPLE II

Figure 2:
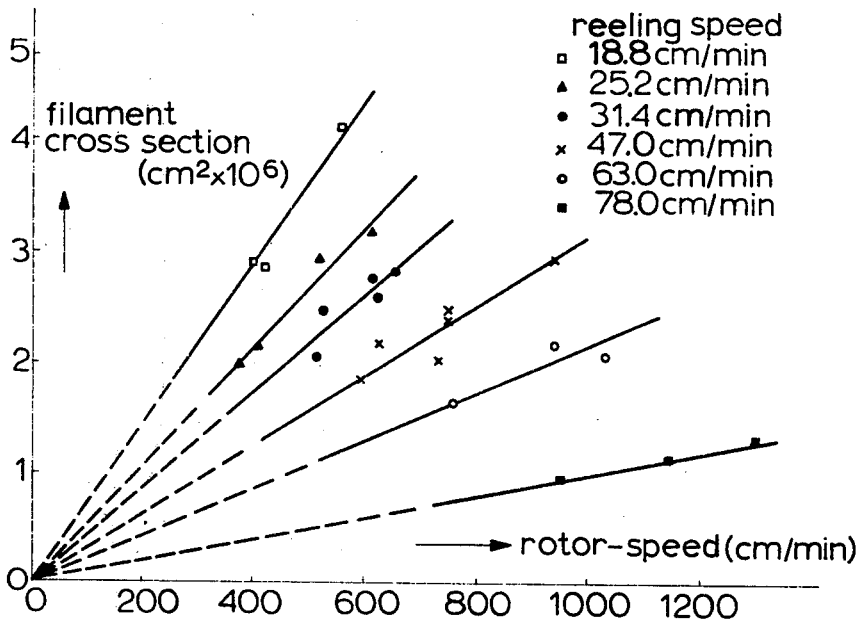
FIG. 2 is a graph showing filament cross-section plotted against rotor speeds at various reeling speeds.

In accordance with the process of Example I, filaments were manufactured from a 1 weight percent solution of Hostalen GUR in p-xylene at 110° C. The reeling speed and the rotor speed were varied. The results are represented in FIG. 2. From said figure it appears that an increasing rotor speed the filaments become thicker. However, when the rotor speed with respect to the reeling speed increases the friction between the filaments and the surface of the rotor increases notwithstanding its increasing thickness and consequently its strength, it appears that when the rotor speed exceeds a certain value filament rupture occurances multiply.

Further, it appears that at given rotor speed, other conditions being equal, different reeling speeds are possible without the filaments being drawn out of the solution or growing further and further around the rotor.

EXAMPLE III

Figure 3:
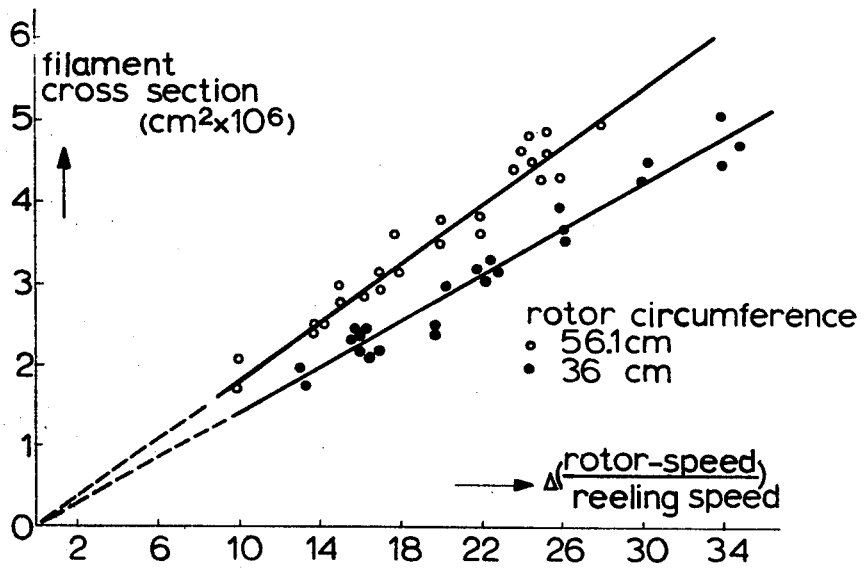
FIG. 3 is a graph showing filament cross-section plotted against reeling speed for two rotors of different circumferences.

In accordance with the process of Example I and the conditions of Example II, filaments were made from a 1 weight percent solution of Hostalene GUR in p-xylene at 110° C in an apparatus as shown schematically in FIG. 1 wherein the rotor had a circumference of 36 cm, and in a similar apparatus with a rotor with a circumference of 56 cm at both different ratios of the rotor speed and the reeling speed. The results are plotted in FIG. 3. At equal ratios of the rotor speed to reeling speed the filaments manufactured in the apparatus with the circumferencially larger rotor are thicker than in the apparatus with the smaller rotor.

EXAMPLE IV

In accordance with the process of Example I, filaments were made from a 1.5 weight percent solution of polypropylene having a melt index of 1.0 in p-xylene. The E-modulus of these filaments was 400 kg/mm$^2$ and the tensile strength was 50 kg/mm$^2$.

EXAMPLE V

In accordance with the process of Example I, filaments were made from a 1 weight percent solution of Hostalene GUR in p-xylene at 119.5° C. the E-modules of the filaments was 10.200 kg/mm$^2$, the tensile strength was 295 kg/mm$^2$ and the elongation at break was only 3.6%.

What is claimed is:

1. A process for preparing continuous filament-like crystals of a crystallizable polymer comprising the steps of:

(a) providing a solution of a crystallizable polymer in a container therefor in contact with a rotating surface;

(b) rotating said solution while growing a seed crystal of said polymer in the flowing solution and allowing the seed crystal to grow longitudinally with respect to the direction of rotation of said polymer solution; and (c) removing the thus grown polymer in the form of a continuous filament from the polymer solution at a rate substantially equal to the polymer crystal growth rate, wherein:

(i) the longitudinal growth takes place at the rotating surface which surface is moving in the direction of the growth of the crystal, and (ii) at least about 15 cm of the filament-like crystal thus produced contacts said surface over a length of at least 15 cm thereof.

2. Process according to claim 1 wherein said polymer solution is contained in a vessel which also contains a rotating, surface roughened rotor.

3. Process according to claim 1 wherein the moving surface is slightly roughened.

4. Process according to claim 1 wherein the longitudinal growth takes place in a Couette flow, in which the filament-like crystal is in contact, over a length of at least 15 cm. with the rotor generating this flow.

5. Process according to claim 3 wherein the moving surface is sandblasted.

6. Process according to claim 3 wherein a non-polar polymer is used and the moving surface is non-polar.

7. Process according to claim 6 wherein the moving surface is silanized.

8. Process according to claim 1 wherein the crystallizable polymer is a linear polyolefin.

9. Process according to claim 8 wherein the linear polyolefin is polyethylene.

10. Process according to claim 8 wherein the linear polyolefine is polypropylene.

11. Process according to claim 8 wherein the solvent is p-xylene.

12. Filaments of polyethylene prepared according to the process of claim 9.

13. In a process for preparing continuous filament-like crystals of a crystallizable polymer comprising the steps of:

(a) providing a solution of a crystallizable polymer in a container therefor in contact with a rotating surface;

(b) rotating said solution while growing a seed crystal of said polymer in the flowing solution and allowing the seed crystal to grow longitudinally with respect to the direction of rotation of said polymer solution; and (c) removing the thus grown polymer in the form of a continuous filament from the polymer solution the improvement comprising removing said filament at a rate substantially equal to the polymer crystal growth rate, wherein:

(i) the longitudinal growth takes place in a Couette flow at a roughened rotor surface generating said flow which surface is moving in the direction of the growth of the crystal, and (ii) at least about 15 cm of the filament-like crystal thus produced contacts said surface over a length of at least 15 cm thereof.

14. Process according to claim 13 wherein the ratio of the rotating speed (b) to the rate of removal of the thus grown polymer (c) is less than 50 to 1.

15. Process according to claim 14 wherein said ratio is 25 to 1.

16. Process according to claim 15 wherein said ratio is 10 to 1.

17. A process for preparing continuous polyethylene filament comprising the steps of:

(a) providing an ethylene solution in a container therefor and in contact with a rotating, roughened surface;

(b) rotating said surface and polyethylene while growing a seed crystal of said polymer in the flowing polyethylene solution and allowing the seed crystal to grow longitudinally with respect to the direction of rotation of the polyethylene solution; and (c) removing the thus grown ethylene polymer in the form of a continuous filament from the polymer solution at a rate substantially equal to the polymer crystal growth rate, wherein:

(i) the longitudinal growth takes place at the rotating surface which surface is roughened and moving in the direction of the growth of the crystal, and (ii) at least about 15 cm of the filament-like crystal thus produced contacts said surface over a length of at least 15 cm thereof, thereby producing a polyethylene filament having a weight of between about 0.0001 and 0.0012 mg/cm, a tensile strength of greater than 100 kg/mm$^2$, an E-modulus of greater than 220 kg/mm$^2$ and an elongation at break of less than 25 percent.

* * * * *